US009212841B2

(12) United States Patent
Kim et al.

(10) Patent No.: US 9,212,841 B2
(45) Date of Patent: Dec. 15, 2015

(54) REFRIGERATOR

(71) Applicant: SAMSUNG ELECTRONICS CO., LTD., Suwon-si, Gyeonggi-do (KR)

(72) Inventors: Do Hyung Kim, Yongin-si (KR); Sang Hyun Park, Seongnam-si (KR); Sang Hoon Lee, Yeoju-gun (KR); Jin Jeong, Yongin-si (KR); Seung Ah Joo, Goyang-si (KR); Qasim Khan, Suwon-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 151 days.

(21) Appl. No.: 13/733,539

(22) Filed: Jan. 3, 2013

(65) Prior Publication Data

US 2013/0174596 A1 Jul. 11, 2013

(30) Foreign Application Priority Data

Jan. 6, 2012 (KR) ..... 10-2012-0002141

(51) Int. Cl.

| | |
|---|---|
| ***F25C 5/16*** | (2006.01) |
| ***F25C 1/04*** | (2006.01) |
| ***F25C 5/18*** | (2006.01) |
| ***F25C 5/04*** | (2006.01) |

(52) U.S. Cl.

CPC ... *F25C 5/16* (2013.01); *F25C 1/04* (2013.01); *F25C 5/046* (2013.01); *F25C 5/182* (2013.01); *F25C 2400/10* (2013.01)

(58) Field of Classification Search

CPC ..... F25C 1/04; F25C 5/16; F25C 5/046; F25C 5/182; F25C 2400/10

USPC ..... 62/320, 340, 344, 354, 381

See application file for complete search history.

(56) References Cited

U.S. PATENT DOCUMENTS

| | | | | |
|---|---|---|---|---|
| 2005/0061017 | A1* | 3/2005 | Lee et al. | 62/340 |
| 2008/0156022 | A1* | 7/2008 | LeClear et al. | 62/344 |
| 2009/0293529 | A1* | 12/2009 | Shinohara et al. | 62/344 |

FOREIGN PATENT DOCUMENTS

KR 10-2010-0096691 9/2010

* cited by examiner

*Primary Examiner* — Mohammad M Ali

(74) *Attorney, Agent, or Firm* — Staas & Halsey LLP

(57) ABSTRACT

A structure of an ice making compartment of a refrigerator capable of enlarging the volume of a storage compartment by reducing a width of an ice making compartment, and capable of easily discharging the whole ice separately from pieces of ice, the refrigerator including an opening/closing member configured to open and close a portion of a discharge hole and having a cover portion to prevent the whole ice from being discharged in a state that the portion of the discharge hole is closed, the refrigerator including an opening/closing member integrally formed with a fixed blade configured to crush ice in cooperation with a rotary blade.

19 Claims, 9 Drawing Sheets

REFRIGERATOR

CROSS-REFERENCE TO RELATED APPLICATIONS

This application claims the benefit of Korean Patent Application No. 10-2012-0002141, filed on Jan. 6, 2012 in the Korean Intellectual Property Office, the disclosure of which is incorporated herein by reference.

BACKGROUND

1. Field

Embodiments of the present disclosure relate to a structure of an ice crusher apparatus being installed on an ice bucket of an ice making compartment.

2. Description of the Related Art

In general, a refrigerator refers to a home appliance provided with a storage compartment configured to store foods and a cool air supply apparatus configured to supply the storage compartment with cool air to keep the foods fresh. The refrigerator may be provided with an ice maker to generate ice and an ice bucket to store the ice generated at the ice maker.

In addition, the ice bucket includes an ice crusher apparatus to crush ice, and an ice crushing space provided with a lower portion having a discharge hole. The ice crusher apparatus includes at least one fixed blade, at least one rotary blade, and an opening/closing member to open and close at least one portion of the discharge hole to select whether the ice is to be crushed.

That is, when the opening/closing member closes at least one portion of the discharge hole, the whole ice generated from the ice maker fails to pass through the discharge hole and is crushed by the fixed blade and the rotary blade. Accordingly, the crushed pieces of ice are discharged through the discharge hole. On the contrary, when the opening/closing member opens the discharge hole, the whole ice generated from the ice maker passes through the discharge hole as it is.

However, in a case that an ice making compartment has a narrow width, an opening angle of the opening/closing member is decreased, thereby making it difficult to selectively discharge the whole ice and the crushed ice.

SUMMARY

Therefore, it is an aspect of the present disclosure to provide a structure of an ice making compartment capable of enlarging the volume of a storage compartment by reducing a width of the ice making compartment.

It is another aspect of the present disclosure to provide a structure of an ice crusher apparatus capable of selectively discharging the whole ice generated from an ice maker and pieces of ice crushed through an ice crusher apparatus in an easy manner.

Additional aspects of the disclosure will be set forth in part in the description which follows and, in part, will be apparent from the description, or may be learned by practice of the disclosure.

In accordance with one aspect of the present disclosure, a refrigerator includes an ice maker, an ice bucket, an auger, at least one rotary blade, at least one fixed blade, and an opening/closing member. The ice maker may be configured to generate ice. The ice bucket may include an ice storage space configured to store the ice being generated from the ice maker, and an ice crushing space formed at a front of the ice storage space, the ice crushing space provided with a lower portion having a discharge hole. The auger may be configured to deliver the ice stored in the ice storage space to the ice crushing space. The at least one rotary blade may be coupled to the auger so as to rotate together with the auger. The at least one fixed blade may be configured to crush ice in cooperation with the at least one rotary blade. The opening/closing member may be configured to rotate on a hinge shaft, and configured to close a portion of the discharge hole to discharge ice being crushed or open the discharge hole to discharge uncrushed ice. The opening/closing member may include a cover portion protruding from one end of the opening/closing member to prevent the uncrushed ice from being discharged through the discharge hole in a state that the opening/closing member closes the portion of the discharge hole.

The cover portion may be located at a region between the ice storage space and a fixed blade, disposed at a nearest position to the ice storage space, among the at least one fixed blade.

A fixed blade, disposed at a nearest position to the ice storage space, among the at least one fixed blade may be spaced apart from the ice storage space by a predetermined interval to discharge the uncrushed ice through the discharge hole in a state the opening/closing member opens the discharge hole.

A hinge shaft accommodating portion may be formed at the other end of the opening/closing member to accommodate the hinge shaft.

The hinge shaft of the opening/closing member may be positioned at a lateral lower side of a rotary shaft of the at least one rotary blade.

One end of each of the at least one fixed blade may be positioned on the rotary shaft of the at least one rotary blade and the other end of each of the at least one fixed blade may be positioned at a lateral upper side of the rotary shaft of the at least one rotary blade.

The refrigerator may further include an auger and a solenoid driving apparatus. The auger motor may be configured to drive the auger. The solenoid driving apparatus may be configured to drive the opening/closing member. The solenoid driving apparatus may be disposed at a front of the auger motor.

In accordance with another aspect of the present disclosure, a refrigerator includes an ice maker, an ice bucket, an auger, at least one rotary blade, and an opening/closing member. The ice maker may be configured to generate ice. The ice bucket may include an ice storage space configured to store the ice being generated from the ice maker, and an ice crushing space formed at a front of the ice storage space, the ice crushing space provided with a lower portion having a discharge hole. The auger may be configured to deliver the ice stored in the ice storage space to the ice crushing space. The at least one rotary blade may be coupled to the auger so as to rotate together with the auger. The opening/closing member may be configured to rotate on a hinge shaft so as to open and close a portion of the discharge hole. The opening/closing member may include at least one fixed blade configured to crush ice in cooperation with the at least one rotary blade. The at least one fixed blade may be integrally formed with the opening/closing member.

The opening/closing member may include a first surface formed in a concave manner to support the ice, and a second surface formed at an opposite side to the first surface in a convex manner. The at least one fixed blade may protrude from the first surface.

The at least one fixed blade may be configured to crush ice in cooperation with the at least one rotary blade in a state that the opening/closing member closes the portion of the discharge hole.

The opening/closing member may include a cover portion protruding from one end of the opening/closing member to prevent uncrushed ice from being discharged through the discharge hole in a state that the opening/closing member closes the portion of the discharge hole.

A hinge shaft accommodating portion may be formed at the other end of the opening/closing member to accommodate the hinge shaft.

The hinge shaft of the opening/closing member may be positioned at a lateral lower side of a rotary shaft of the at least one rotary blade.

The refrigerator may further include an auger motor and a solenoid driving apparatus. The auger motor may be configured to drive the auger. The solenoid driving apparatus may be configured to drive the opening/closing member. The solenoid driving apparatus may be disposed at a front of the auger motor.

In accordance with another aspect of the present disclosure, a refrigerator includes a body, a storage compartment, an ice making compartment, a cool air supply apparatus, an ice making tray, an ice bucket, an auger, at least one rotary bade, at least one fixed blade, an opening/closing member, and a solenoid driving apparatus. The storage compartment may be formed at an inside the body. The ice making compartment may be configured to be partitioned from the storage compartment at the inside the body. The cool air supply apparatus, in order to supply cool air, may include a compressor, a condenser, an expansion apparatus, an evaporator and a refrigerant pipe while having a portion of the refrigerant pipe disposed at the ice making compartment. The ice making tray may be configured to directly receive a cooling energy while making a contact with the refrigerant pipe of the ice making compartment. The ice bucket may include an ice storage space configured to store ice being separated from the ice making tray, and an ice crushing space formed at a front of the ice storage space, the ice crushing space provided with a lower portion having a discharge hole. The auger may be configured to deliver the ice stored in the ice storage space to the ice crushing space. The at least one rotary blade may be coupled to the auger to rotate together with the auger. The at least one fixed blade may be configured to crush ice in cooperation with the at least one rotary blade. The opening/closing member may be configured to rotate on a hinge shaft, and configured to close a portion of the discharge hole to discharge ice being crushed or open the discharge hole to discharge uncrushed ice. The solenoid driving apparatus may be configured to rotate the opening/closing member in connection with the opening/closing member. The opening/closing member may include a cover portion protruding from one end of the opening/closing member to prevent the uncrushed ice from being discharged through the discharge hole in a state that the opening/closing member closes the portion of the discharge hole. The hinge shaft of the opening/closing member may be positioned at a lateral lower side of a rotary shaft of the at least one rotary blade. The solenoid driving apparatus may be disposed at a front of an auger motor configured to drive the auger.

As described above, according to the embodiments of the present disclosure, the width of the ice making compartment is reduced, so that the volume of the storage compartment is enlarged.

In addition, even if the width of the ice making compartment is reduced, the selective discharge between the whole ice and the pieces of ice is achieved in an easy manner.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
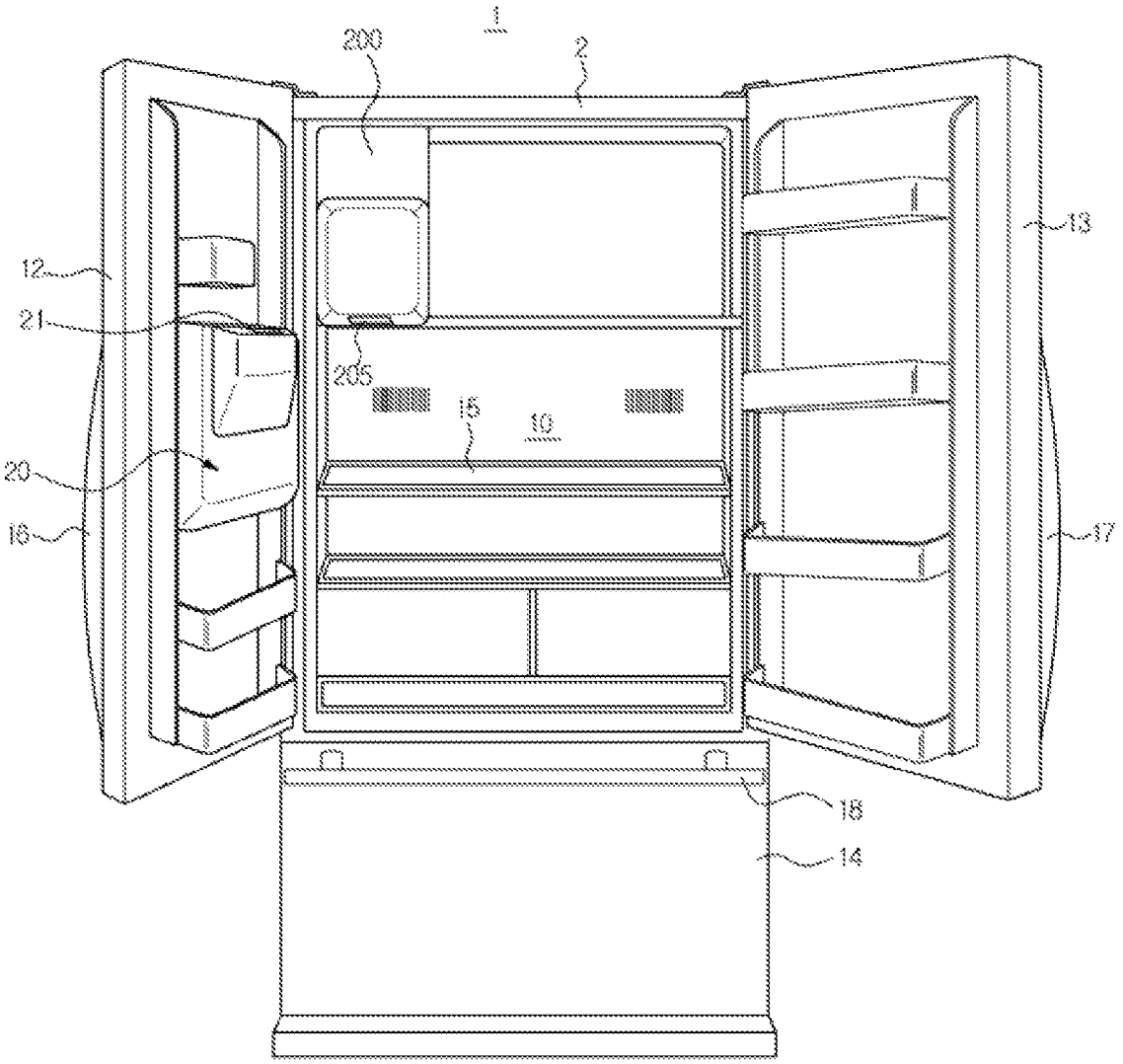
FIG. 1 is a front view illustrating a refrigerator in accordance with the first embodiment of the present disclosure.

Reference will now be made in detail to the embodiments of the present disclosure, examples of which are illustrated in the accompanying drawings, wherein like reference numerals refer to like elements throughout.

Figure 2:
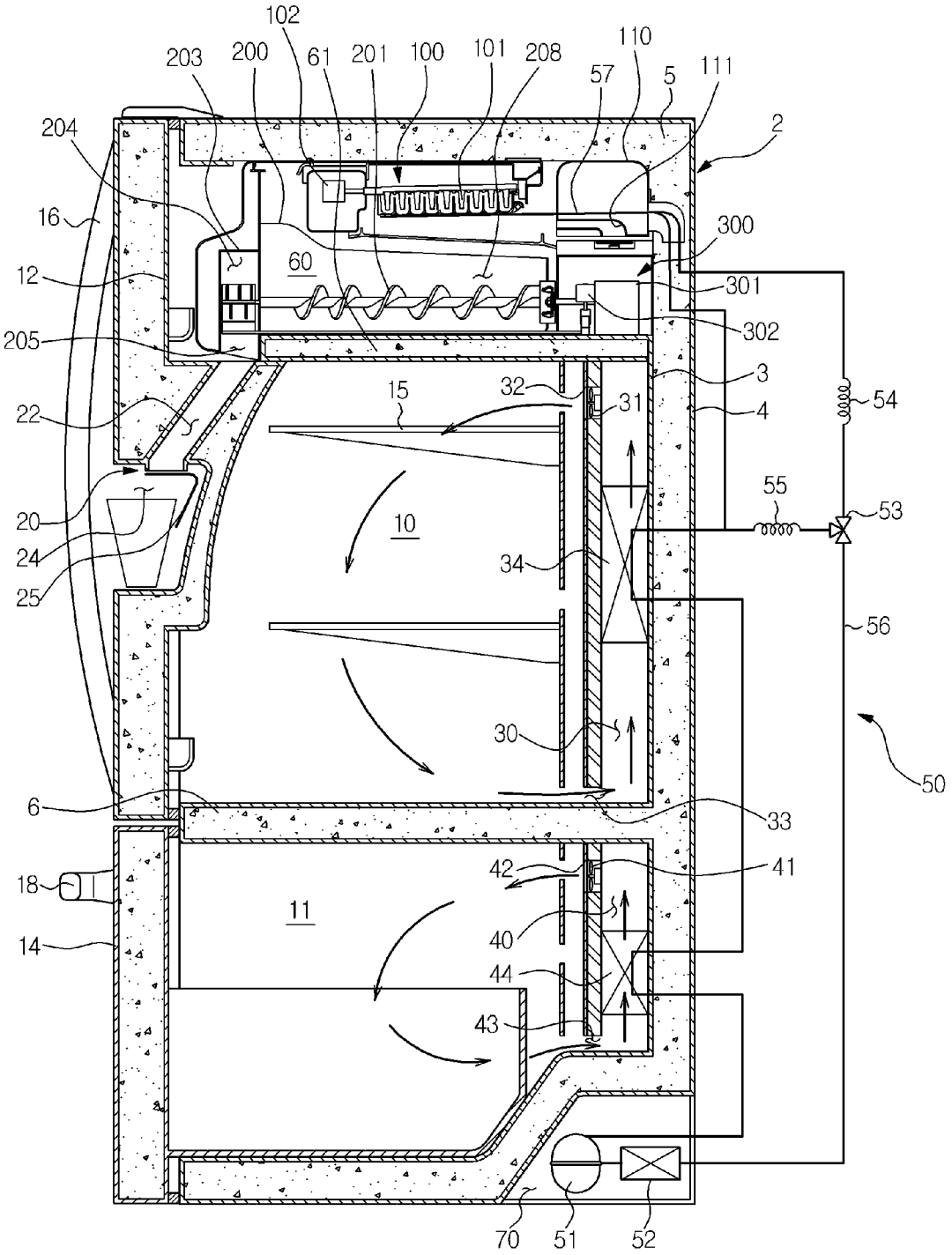
FIG. 2 is a cross sectional view illustrating the refrigerator of FIG. 1.
Figure 3:
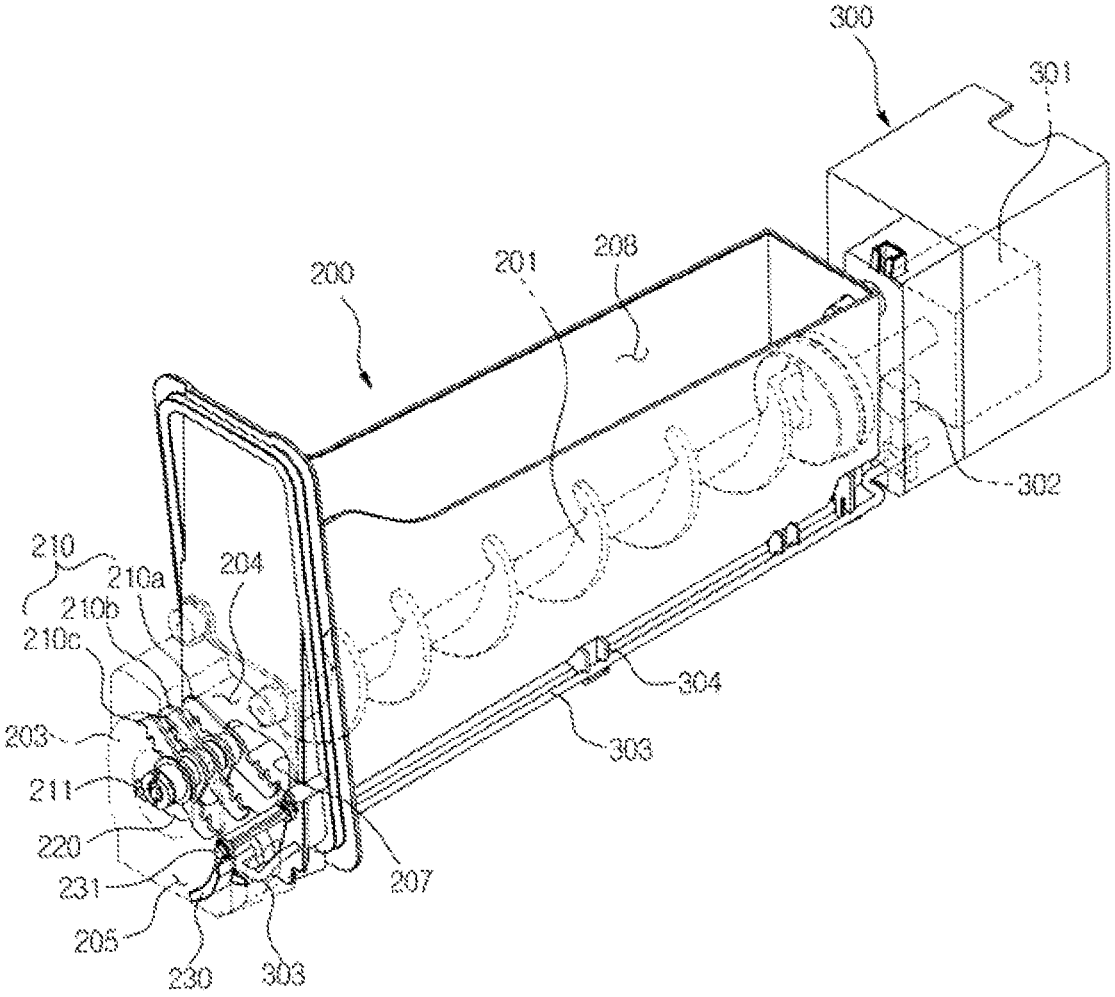
FIG. 3 is a perspective view illustrating components of an ice bucket and an ice crusher apparatus of the refrigerator of FIG. 1.
Figure 4:
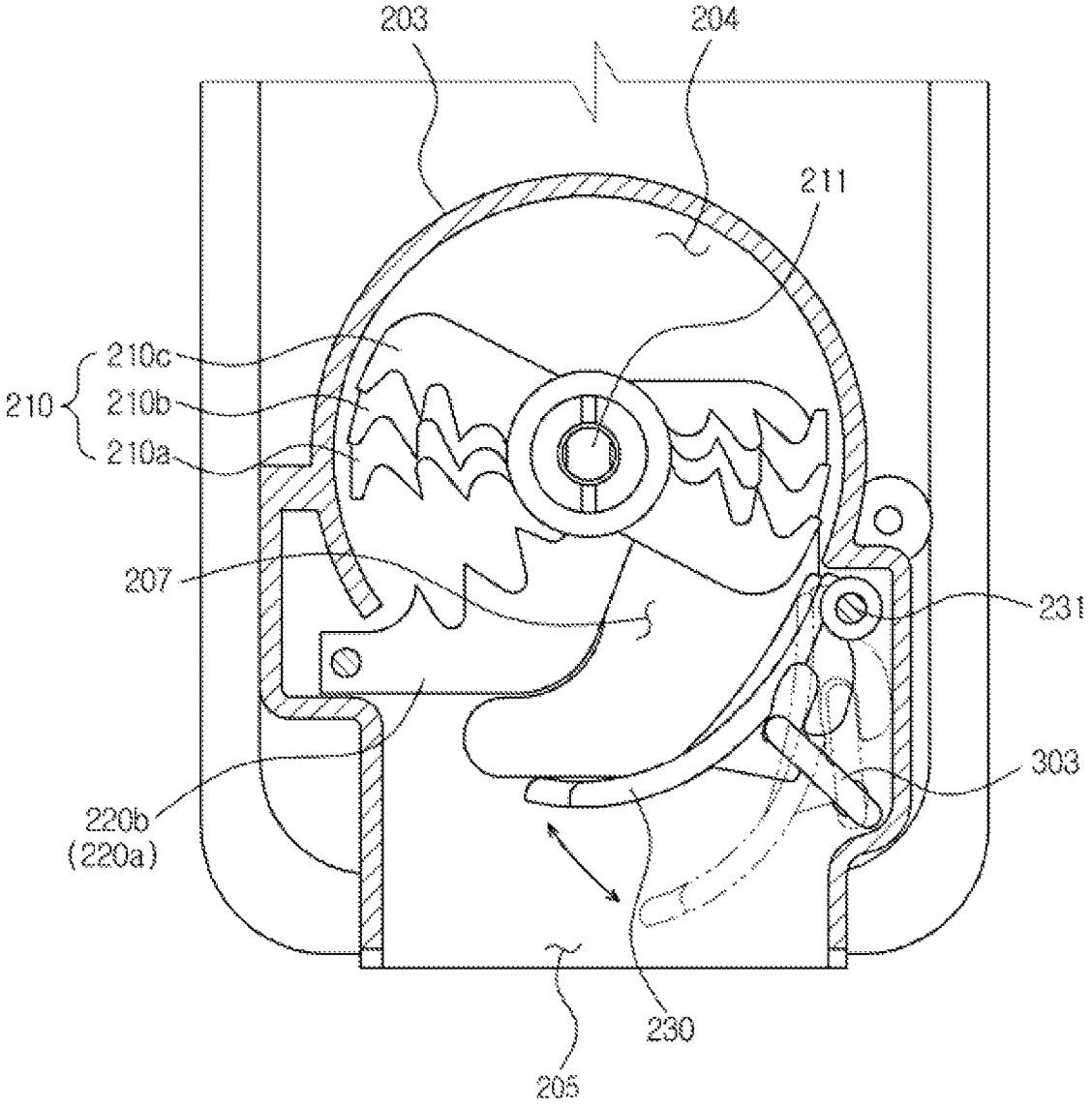
FIG. 4 is a front view illustrating components of the ice crusher apparatus of the refrigerator of FIG. 1.
Figure 5:
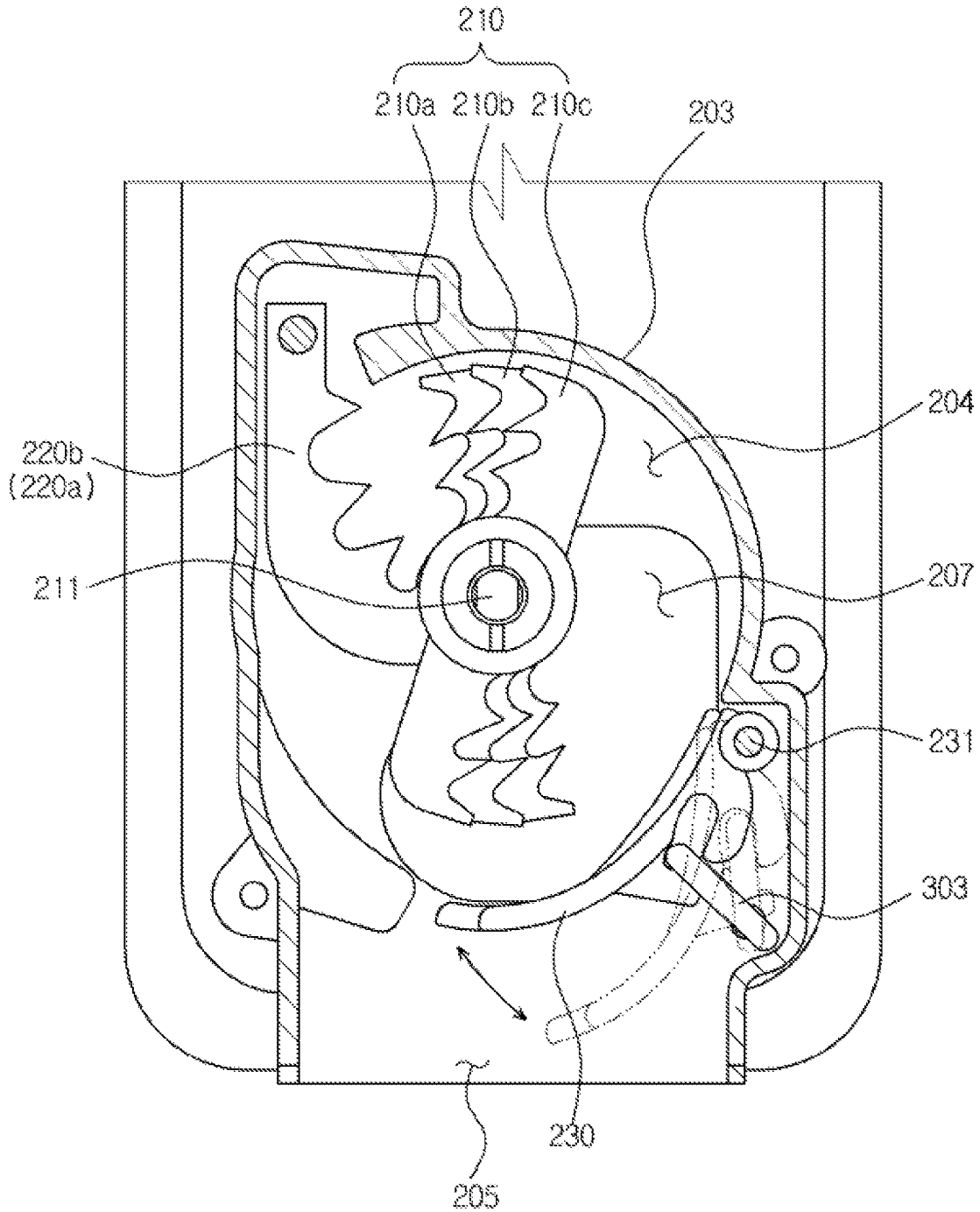
FIG. 5 is a cross sectional view illustrating components of an ice crusher apparatus in accordance with the second embodiment of the present disclosure.

FIG. 1 is a front view illustrating a refrigerator in accordance with the first embodiment of the present disclosure. FIG. 2 is a cross sectional view illustrating the refrigerator of FIG. 1. FIG. 3 is a perspective view illustrating components of an ice bucket and an ice crusher apparatus of the refrigerator of FIG. 1. FIG. 4 is a front view illustrating components of the ice crusher apparatus of the refrigerator of FIG. 1. FIG. 5 is a cross sectional view illustrating components of an ice crusher apparatus in accordance with the second embodiment of the present disclosure.

Referring to FIGS. 1 and 2, a refrigerator 1 includes a body 2, storage compartments 10 and 11 to keep food frozen or cooled, an ice making compartment 60 to generate ice, and a cool air supply apparatus 50 to supply the ice making compartment 60 with cool air.

The body 2 includes an outer case 4 forming the external appearance of the body 2, an inner case 3 forming the storage compartments 10 and 11, and an insulation material 5 foamed between the outer case 4 and the inner case 3.

The storage compartments 10 and 11 have front surfaces being open. The storage compartment 10 and 11 are divided by a horizontal partition wall 6 into a refrigerating compartment 10 and a freezing compartment 11 at the upper portion and the lower portion, respectively. The horizontal partition wall 6 may include insulation material to block the heat exchanged between the refrigerating compartment 10 and the freezing compartment 11.

The refrigerating compartment 10 may be provided with a shelf 9 on which food is placed and which serves to partition a storage space of the refrigerating compartment 10 into an upper portion and a lower portion. The open front surface of the refrigerating compartment 10 may be open and closed by a pair of doors 12 and 13 that are hingedly coupled to the body 2 so as to enable rotation. Handles 16 and 17 are provided at the doors 12 and 13, respectively, to open and close the doors 12 and 13.

A dispenser 20 is provided at the doors 12 and 13 such that ice being generated from the ice making compartment 60 is taken out from the outside without opening the doors 12 and 13. The dispenser 20 includes a take-out space 24 to take out ice, a lever 25 to select whether ice is to be taken out, and a chute 22 to guide the ice being discharged through an ice withdrawal hole 21 which is adjacent to an ice discharge hole 205 of an ice bucket 200, which is to be described later, toward the take-out space 24.

The open front surface of the freezing compartment 11 may be open and closed by a sliding door 14 available to be inserted into the freezing compartment 11 in a sliding manner. A rear surface of the sliding door 14 is integrally formed with a storage box on which food is contained. The sliding door 14 is provided with a handle 18 to open and close the sliding door 14.

Referring to FIG. 2, the refrigerator 1 includes the cool air supply apparatus 50 configured to supply the storage compartments 10 and 11 and the ice making compartment 60 with cool air. The cool air supply apparatus 50 includes a compressor 51 to compress refrigerant into a high pressure refrigerant, a condenser 52 to condense the compressed refrigerant, expansion apparatuses 54 and 55 to expand the refrigerant into a low pressure refrigerant for easy evaporation, evaporators 34 and 44 to generate cool air by evaporating the refrigerant, and a refrigerant pipe 56 to guide the refrigerant.

The compressor 51 and the condenser 52 are disposed at a machine room 70 being provided at a lower portion of a rear side of the body 2. In addition, the evaporators 34 and 44 are disposed at a refrigerating compartment cool air supply duct 30 provided at the refrigerating compartment 10 and at a freezing compartment cool air supply duct 40 provided at the freezing compartment 11. Accordingly, the refrigerating compartment 10 and the freezing compartment 11 may be cooled independent of each other.

The refrigerating compartment cool air supply duct 30 includes a suction port 33, a cool air discharge port 32, and a blower fan 31, to circulate the cool air at the inside the refrigerating compartment 10. In addition, the freezing compartment coo air supply duct 40 includes a suction port 43, a cool air discharge port 42 and a blower fan 41, to circulate the cool air at the inside the freezing compartment 11.

Meanwhile, a portion of the refrigerant pipe 56 is disposed to be extended to the inside the ice making compartment 60 to cool the ice making compartment 60.

The refrigerant pipe 56 is diverged at one point thereof such that a refrigerant flows to the ice making compartment 60, the refrigerating compartment 10 and the freezing compartment 11 in a sequential manner, or flows only to the refrigerating compartment 10 and the freezing compartment 11 except for the ice making compartment 60. In addition, a switching valve 53 may be installed at the diverged portion of the refrigerant pipe 56 to switch the path of refrigerant. In addition, the refrigerant pipe 57 disposed at the inside the ice making compartment 60 makes a direct contact with an ice making tray 101 of an ice maker 100 to directly supply the cooling energy.

Meanwhile, the ice making compartment 60 is provided to be partitioned from the storage compartments 10 and 11 at the inside the body 2. In addition, the ice making compartment 60 has a front surface configured to be open. The open front surface of the ice making compartment 60 is closed by an ice making compartment cover portion of the ice bucket.

The ice making compartment 60 is provided at an upper portion of one side of the refrigerating compartment 10 while being partitioned from the refrigerating compartment 10 by an ice making compartment wall 61. The ice making compartment wall 61 may include insulation material to prevent heat exchange between the ice making compartment 60 and the refrigerating compartment 10.

The ice making compartment 60 is provided with an automatic ice making assembly to generate ice. The automatic ice making assembly includes a refrigerant pipe fixing duct 110, which is configured to fix the refrigerant pipe 57 and form a portion of the cool air path at the inside the ice making compartment 60, the ice maker 100 to generate ice, the ice bucket 200 to store the ice being generated from the ice maker 100, and an auger motor 301 provided at a rear of the ice bucket 200 to drive the auger 201.

In addition, a solenoid driving apparatus 302 is provided at a front of the auger motor 301 to rotate an opening/closing member 230 of an ice crusher apparatus that is to be described later. Accordingly, when compared to the conventional structure in which the auger motor is disposed at a lateral side of the solenoid driving apparatus, the ice making compartment 60 in accordance with the present disclosure has a slim width.

The ice making tray 101 includes a plurality of ice making cells, each of which has a cross section in an approximate semi-circular shape, so that the ice being generated from the ice making tray 101 is provided with a cross section in an approximate semi-circular shape. Hereinafter, the ice provided in a semi-circular shape is referred to as a whole ice. An ice separating motor 102 is configured to rotate the ice making tray 101 to deliver the whole ice to the ice bucket 200.

The ice bucket 200 may further include an ice storage space 208 to store the ice, an ice crushing space 204 formed at a front of the ice storage space 208 to crush the ice, and an auger 201 to deliver the ice from the ice storage space 208 to the ice crushing space 204.

The ice storage space 208 and the ice crushing space 204 are divided by a partition portion (206 in FIG. 6) from each other, and ice is delivered from the ice storage space 208 to the ice crushing space 204 through a communicating portion (207 in FIG. 6) that is formed at the partition portion 206. The ice crushing space 204 is formed by the partition portion 206 and a cover (203 in FIG. 2) coupled at a front surface of the partition portion 206.

The ice crushing space 204 is provided with a crusher apparatus to crush the whole ice being generated from the ice maker 100. Hereinafter, the ice being crushed by the crusher apparatus is referred to as pieces of ice.

The crusher apparatus includes at least one rotary blade 210, at least one fixed blade 220, and the opening/closing member 230 to open and close a portion of the discharge hole 205 formed at the lower portion of the ice crushing space 204. The at least one fixed blade 220 is provided in a number that is one less than the at least one rotary blade 210 while being disposed between the rotary blades 210. As one example, the at least one fixed blade may be provided in two units of fixed blades 220*a* and 220*b*, and the at least one rotary blade may be provided in three units of rotary blades 210*a*, 210*b*, and 210*c*.

The rotary blade 210 is configured to radially protrude from a rotary shaft 211 of the auger 201. In addition, the rotary blade 210 is configured to rotate together with the auger 201.

Meanwhile, the opening/closing member 230 may be hingedly coupled between the cover 203 and the partition portion 206. A hinge shaft accommodating portion (232 in FIG. 7) may be provided at one end of the opening/closing member 230 to accommodate a hinge shaft.

In addition, the opening/closing member 230 may be connected to the solenoid driving apparatus 302 through a connection member 303. The opening/closing member 230 is provided with a connection member accommodating portion 234 formed thereon to which the connection member 303 is connected. The translation motion of the connection member 303 is limited by a clamping apparatus 304 fixed to the ice bucket 300.

Accordingly, as the solenoid driving apparatus 302 moves up and down, the connection member 303 performs a rotary motion, and as a result, the opening/closing member 230 connected to the connection member 303 is rotated on a rotary shaft 231 to open and close a portion of the discharge hole 205.

When the opening/closing member 230 closes a portion of the discharge hole 205, the whole ice being generated from the ice maker 100 is stuck between the discharge hole 205 and the opening/closing member 230 and is prevented from being discharged through the discharge hole 205. In this case, when the rotary blade 210 is rotated, the ice is crushed while being stuck between the rotary blade 210 and the fixed blade 220. The pieces of ice crushed are discharged through the discharge hole 205.

Referring to FIGS. 4 and 5, the rotary shaft 231 of the opening/closing member 230 is disposed at a lateral lower side of the rotary shaft 211 of the rotary blade 210 such that an opening angle of the opening/closing member 302 is increased.

As shown in FIG. 4, one end of each of the fixed blades 220*a* and 220*b* is disposed on the rotary shaft 211 of the rotary blade 210, and the other end of each of the fixed blades 220*a* and 220*b* is disposed at a lateral lower side of the rotary shaft 211 of the rotary blade 210. As shown in FIG. 5, one end of each of the fixed blades 220*a* and 220*b* is disposed on the rotary shaft 211 of the rotary blade 210, and the other end of each of the fixed blades 220*a* and 220*b* is disposed at a lateral upper side of the rotary shaft 211 of the rotary blade 210.

Referring to FIG. 5, when one end of each of the fixed blades 220*a* and 220*b* is disposed on the rotary shaft 211 of the rotary blade 210, and the other end of each of the fixed blades 220*a* and 220*b* is disposed at a lateral upper side of the rotary shaft 211 of the rotary blade 210, even though the width of the ice making compartment 60 becomes narrower, the ice is easily discharged through the discharge hole 205 without being stuck at the fixed blades 220*a* and 220*b*. In addition, the opening angle of the opening/closing member 230 is designed to be larger.

Figure 6:
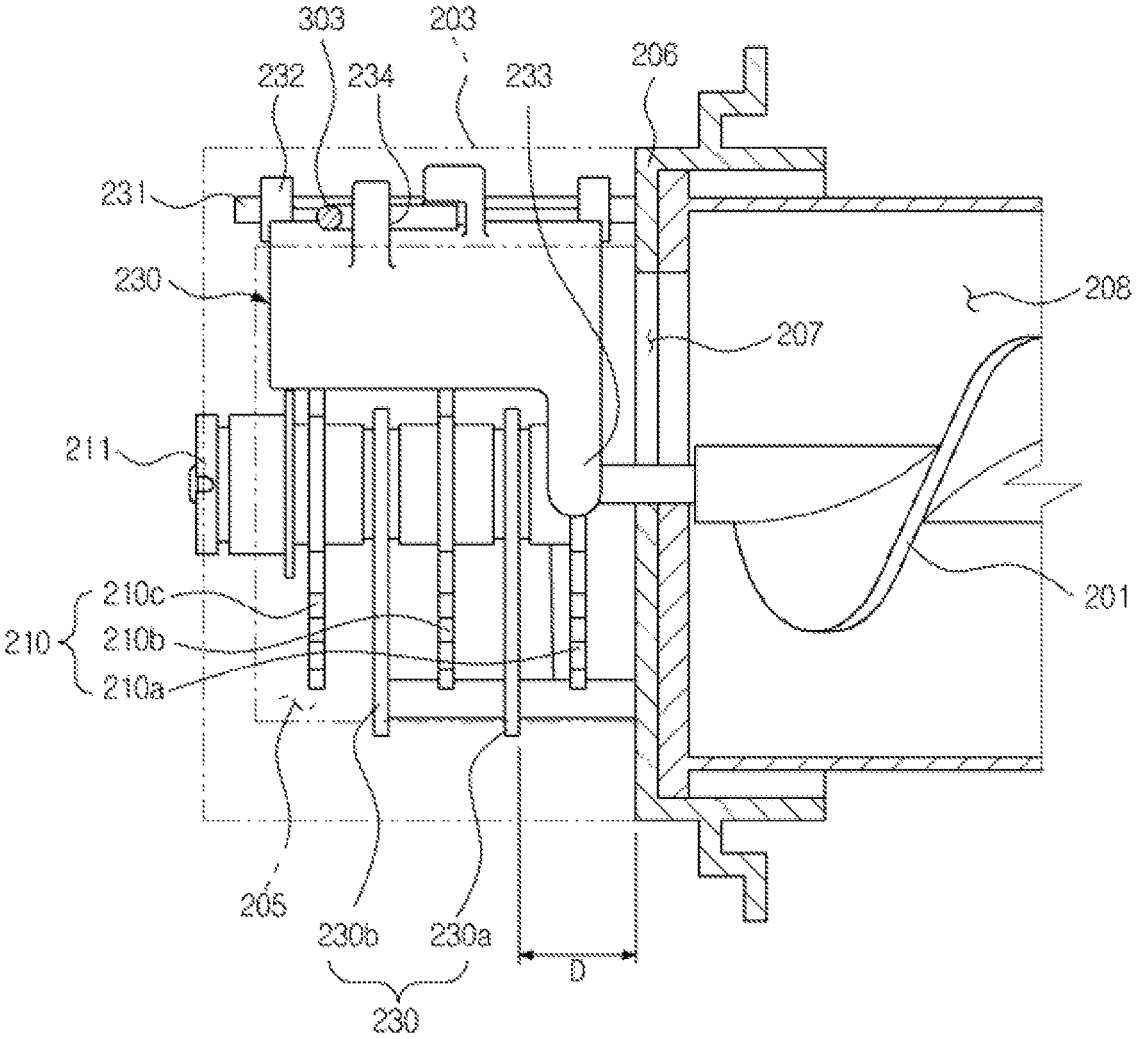
FIG. 6 is a cross sectional view illustrating components of an ice crusher apparatus in accordance with the third embodiment of the present disclosure.
Figure 7:
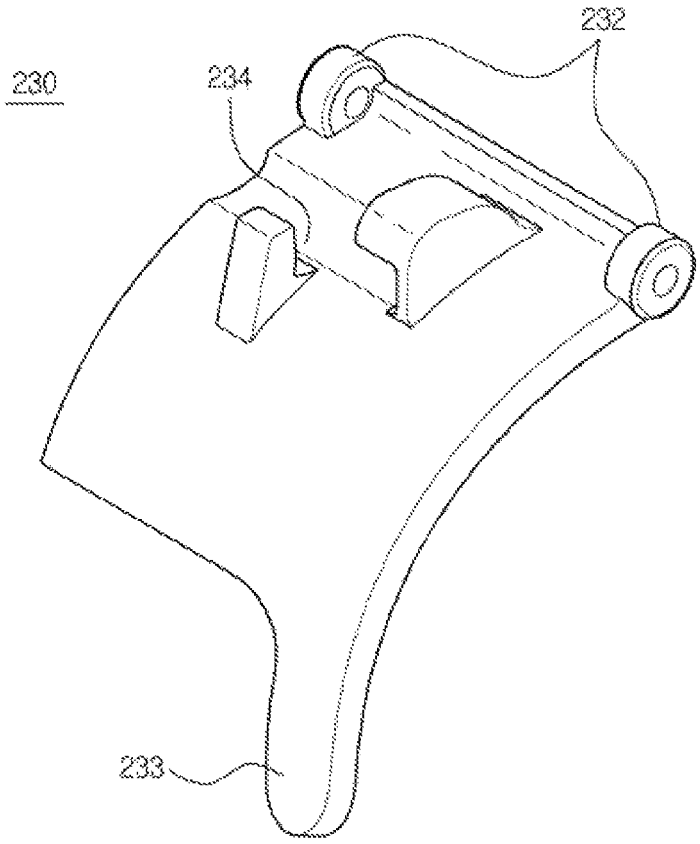
FIG. 7 is a view illustrating an opening/closing member of the refrigerator of FIG. 6.

FIG. 6 is a cross sectional view illustrating components of an ice crusher apparatus in accordance with the third embodiment of the present disclosure. FIG. 7 is a view illustrating an opening/closing member of the refrigerator of FIG. 6. In the following description, the same reference numerals will be assigned to the parts of the present embodiment that are identical to those according to the previous embodiments, and details of parts will be omitted in order to avoid redundancy.

Referring to FIGS. 6 and 7, in a refrigerator in accordance with the third embodiment of the present disclosure, a first fixed blade 230*a*, disposed at the nearest position to the ice storage space 208, of the fixed blades 230*a* and 230*b* is spaced apart by a predetermined interval D from the partition portion 206 that is configured to partition the ice crushing space 204 from the ice storage space 208, so as to prevent the whole ice from being stuck at the first fixed blade 230*a* and failing to be discharged in a state that the opening/closing member 230 opens the discharge hole 205.

On the contrary, the opening/closing member 230 further includes a cover portion 233 configured such that the whole ice is prevented from being discharged through the discharge hole 205 in a state that the opening/closing member 230 closes a portion of the discharge hole 205. In this case, the cover portion 233 is provided at an opposite end to the hinge shaft accommodating portion 232.

By having the cover portion 233 disposed between the first fixed blade 230*a* and the ice storage space 208 as shown in FIG. 6, the whole ice is prevented from being discharged through the discharge hole 205 via a gap between the first fixed blade 230*a* and the partition portion 206.

Figure 8:
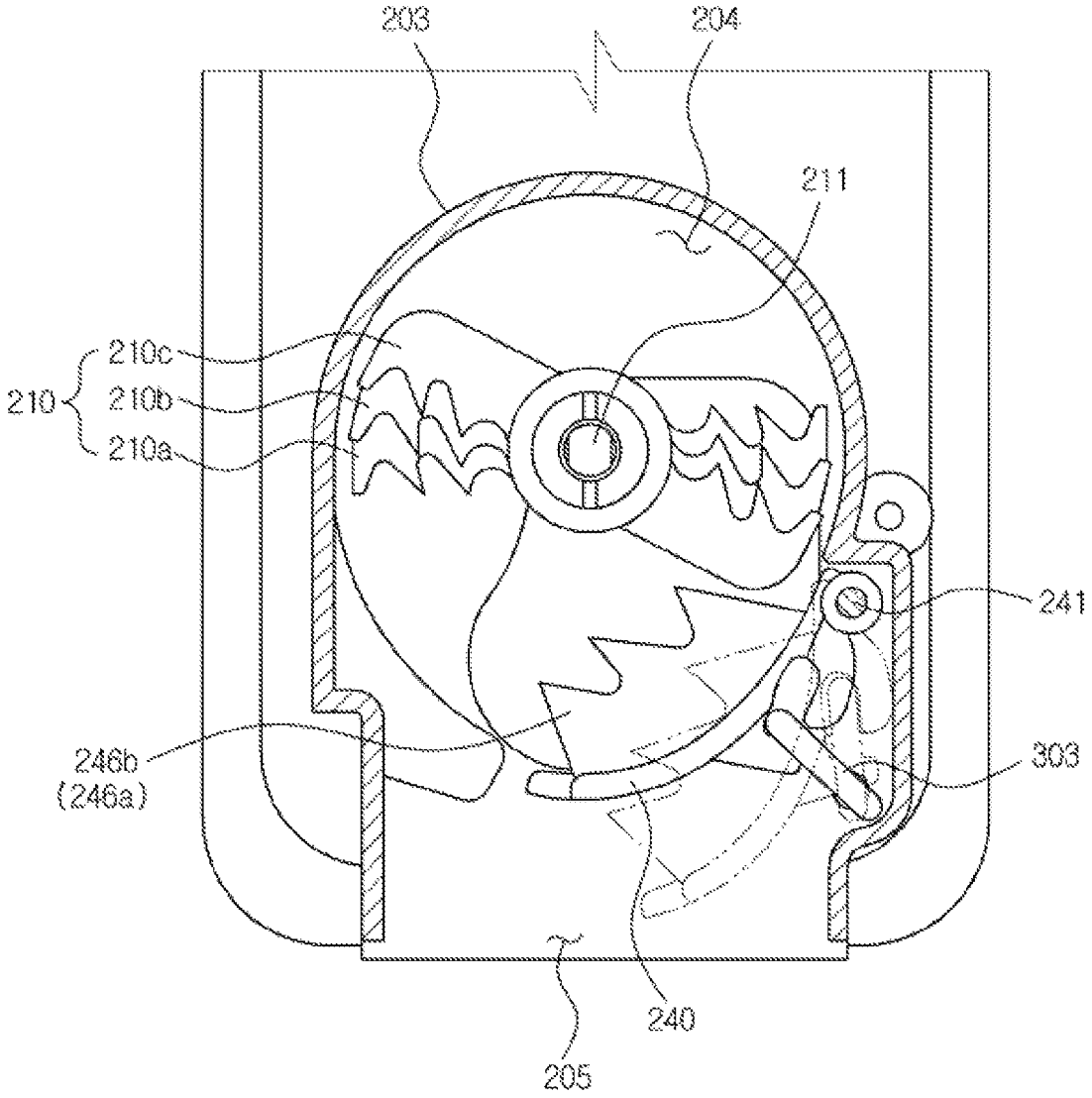
FIG. 8 is a front view illustrating components of an ice crusher apparatus in accordance with the fourth embodiment of the present disclosure.
Figure 9:
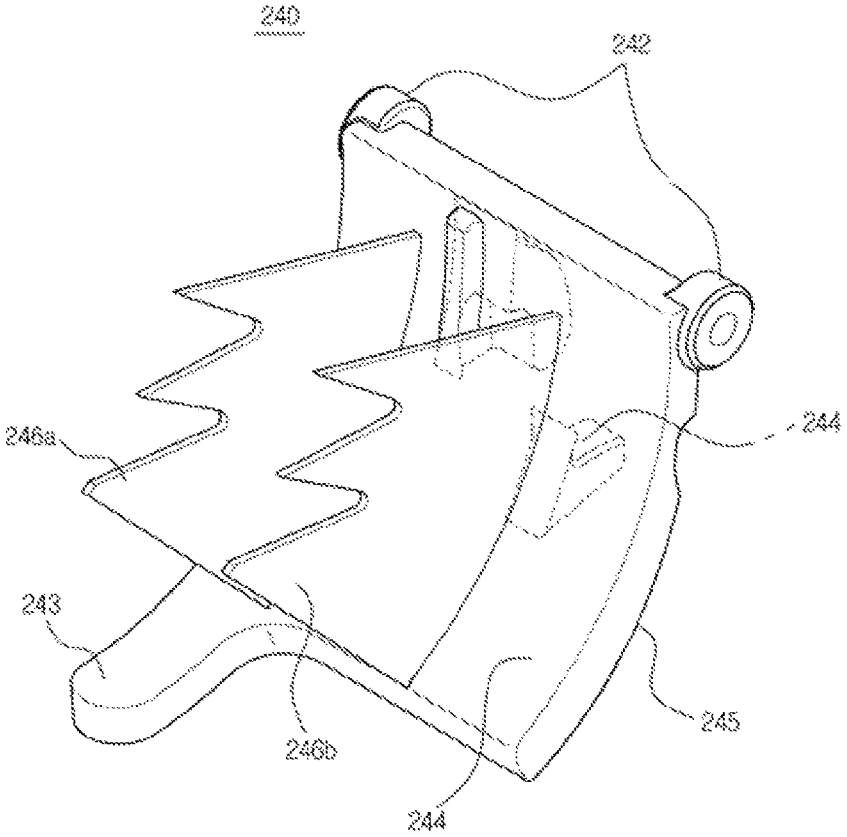
FIG. 9 is a view illustrating an opening/closing member of the refrigerator of FIG. 8.

FIG. 8 is a front view illustrating components of an ice crusher apparatus in accordance with the fourth embodiment of the present disclosure. FIG. 9 is a view illustrating an opening/closing member of the refrigerator of FIG. 8. In the following description, the same reference numerals will be assigned to the parts of the present embodiment that are identical to those according to the previous embodiments, and details of parts will be omitted in order to avoid redundancy.

Different from the previous embodiments described above, a refrigerator in the fourth embodiment of the present disclosure has fixed blades 246*a* and 246*b* integrally formed with an opening/closing member 240.

That is, the opening/closing member 240 is provided with the fixed blades 246*a* and 246*b* in addition to a shaft accommodating portion 242, a cover portion 243 and a connection member accommodating portion 244, so that the fixed blades 246*a* and 246*b* crush ice in cooperation with the rotary blade 210.

The opening/closing member 240 includes a first surface 244 formed in a concave manner and a second surface 245 formed in a convex manner. The fixed blades 246*a* and 246*b* are formed on the first surface 244, and the connection member accommodation portion 244 is formed on the second surface 245.

Through the structure as such, the opening/closing member 240 crushes the ice in cooperation with the rotary blade 210 while opening/closing the discharge hole 205.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A refrigerator comprising:

an ice maker configured to make ice;

an ice bucket comprising an ice storage space configured to store the ice being made from the ice maker, and an ice crushing space provided with a lower portion having a discharge hole;

an auger configured to deliver the ice stored in the ice storage space to the ice crushing space;

at least one rotary blade coupled to the auger so as to rotate together with the auger;

at least one fixed blade configured to crush ice in cooperation with the at least one rotary blade; and an opening/closing member configured to rotate on a hinge shaft, and configured to close a portion of the discharge hole to discharge ice being crushed or open the discharge hole to discharge uncrushed ice, wherein the opening/closing member comprises a cover portion protruding from one end of the opening/closing member to prevent the uncrushed ice from being discharged through the discharge hole in a state that the opening/closing member closes the portion of the discharge hole.

2. The refrigerator of claim 1, wherein the cover portion is located at a region between the ice storage space and the at least one fixed blade, disposed at a nearest position to the ice storage space, among the at least one fixed blade.

3. The refrigerator of claim 1, wherein the at least one fixed blade, disposed at a nearest position to the ice storage space, among the at least one fixed blade is spaced apart from the ice storage space by a predetermined interval to discharge the uncrushed ice through the discharge hole in a state the opening/closing member opens the discharge hole.

4. The refrigerator of claim 1, wherein a hinge shaft accommodating portion is formed at another end of the opening/closing member to accommodate the hinge shaft.

5. The refrigerator of claim 1, wherein the hinge shaft of the opening/closing member is positioned at a lateral lower side of a rotary shaft of the at least one rotary blade.

6. The refrigerator of claim 1, wherein one end of each of the at least one fixed blade is positioned on a rotary shaft of the at least one rotary blade and the another end of each of the at least one fixed blade is positioned at a lateral upper side of the rotary shaft of the at least one rotary blade.

7. The refrigerator of claim 1, further comprising:

an auger motor configured to drive the auger; and a solenoid driving apparatus configured to drive the opening/closing member, wherein the solenoid driving apparatus is disposed at a front of the auger motor.

8. A refrigerator comprising:

an ice maker configured to make ice;

an ice bucket comprising an ice storage space configured to store the ice being made from the ice maker, and an ice crushing space provided with a lower portion having a discharge hole;

an auger configured to deliver the ice stored in the ice storage space to the ice crushing space;

at least one rotary blade coupled to the auger so as to rotate together with the auger; and an opening/closing member configured to rotate on a hinge shaft so as to open and close a portion of the discharge hole, wherein the opening/closing member comprises at least one fixed blade configured to crush ice in cooperation with the at least one rotary blade, and wherein the at least one fixed blade is integrally formed with the opening/closing member.

9. The refrigerator of claim 8, wherein:

the opening/closing member comprises a first surface formed in a concave manner to support the ice, and a second surface formed at an opposite side to the first surface in a convex manner, and the at least one fixed blade protrudes from the first surface.

10. The refrigerator of claim 8, wherein the at least one fixed blade is configured to crush ice in cooperation with the at least one rotary blade in a state that the opening/closing member closes the portion of the discharge hole.

11. The refrigerator of claim 8, wherein the opening/closing member comprises a cover portion protruding from one end of the opening/closing member to prevent uncrushed ice from being discharged through the discharge hole in a state that the opening/closing member closes the portion of the discharge hole.

12. The refrigerator of claim 11, wherein a hinge shaft accommodating portion is formed at another end of the opening/closing member to accommodate the hinge shaft.

13. The refrigerator of claim 8, wherein the hinge shaft of the opening/closing member is positioned at a lateral lower side of a rotary shaft of the at least one rotary blade.

14. The refrigerator of claim 8, further comprising:

an auger motor configured to drive the auger; and a solenoid driving apparatus configured to drive the opening/closing member, wherein the solenoid driving apparatus is disposed at a front of the auger motor.

15. A refrigerator comprising:

a body;

a storage compartment formed inside the body;

an ice making compartment configured to be partitioned from the storage compartment inside the body;

a cool air supply apparatus, in order to supply cool air, comprising a compressor, a condenser, an expansion apparatus, an evaporator and a refrigerant pipe, a portion of the refrigerant pipe being disposed in the ice making compartment;

an ice making tray configured to directly receive a cooling energy while making a contact with the refrigerant pipe of the ice making compartment;

an ice bucket comprising an ice storage space configured to store ice being separated from the ice making tray, and an ice crushing space provided with a lower portion having a discharge hole;

an auger configured to deliver the ice stored in the ice storage space to the ice crushing space;

at least one rotary blade coupled to the auger to rotate together with the auger;

at least one fixed blade configured to crush ice in cooperation with the at least one rotary blade;

an opening/closing member configured to rotate on a hinge shaft, and configured to close a portion of the discharge hole to discharge ice being crushed or open the discharge hole to discharge uncrushed ice, and a solenoid driving apparatus configured to rotate the opening/closing member, wherein the opening/closing member comprises a cover portion protruding from one end of the opening/closing member to prevent the uncrushed ice from being discharged through the discharge hole in a state that the opening/closing member closes the portion of the discharge hole, the hinge shaft of the opening/closing member is positioned at a lateral lower side of a rotary shaft of the at least one rotary blade, and the solenoid driving apparatus is disposed at a front of an auger motor configured to drive the auger.

16. An ice maker for a refrigerator comprising:

an ice making tray;

an ice bucket to store ice made in the ice making tray, the ice bucket including an ice storing space and an ice crushing space having a discharge hole at a lower portion thereof;

an auger to deliver the ice from the ice storage space to the ice crushing space;

at least one rotary blade coupled to the auger so as to rotate together with the auger;

at least one fixed blade configured to crush the ice in cooperation with the at least one rotary blade; and an opening/closing member configured to rotate on a hinge shaft, the opening/closing member includes a cover portion protruding from one end of the opening/closing member to only partially close a portion of the discharge hole in a closed position.

17. The ice maker of claim 16, wherein the cover portion is located at a region between the ice storage space and the at least one fixed blade, disposed at a nearest position to the ice storage space, among the at least one fixed blade.

18. The ice maker of claim 17, wherein the at least one fixed blade disposed at the nearest position to the ice storage space is spaced apart from the ice storage space by a predetermined interval to discharge uncrushed ice through the discharge hole when the opening/closing member is in an open position.

19. The ice maker of claim 16, wherein one end of each of the at least one fixed blade is positioned on a rotary shaft of the at least one rotary blade and the other end of each of the at least one fixed blade is positioned at a lateral upper side of the rotary shaft of the at least one rotary blade.

* * * * *